United States Patent [19]

Pappas et al.

[11] 4,255,160

[45] Mar. 10, 1981

[54] FLOW IMPROVER FOR HEAVY PETROLEUM PRODUCTS COMPRISING ALKENYL SUCCINATE DIESTER

[75] Inventors: Peter G. Pappas, Downers Grove; Adel B. Abdul-Malek, Naperville, both of Ill.

[73] Assignee: Standard Oil Company (Indiana), Chicago, Ill.

[21] Appl. No.: 18,995

[22] Filed: Mar. 9, 1979

[51] Int. Cl.[3] ..... C10L 1/18

[52] U.S. Cl. ..... 44/70; 44/77

[58] Field of Search ..... 44/70, 77

[56] References Cited

U.S. PATENT DOCUMENTS

| | | | |
|---|---|---|---|
| 3,381,022 | 4/1968 | LeSuer | 44/70 |
| 3,447,916 | 6/1969 | Edwards | 44/70 |
| 3,632,510 | 1/1972 | LeSuer | 44/70 |
| 4,036,772 | 7/1977 | Dorer, Jr. | 44/70 |
| 4,113,442 | 9/1978 | Hoff et al. | 44/70 |
| 4,135,887 | 1/1979 | Rossi | 44/70 |

FOREIGN PATENT DOCUMENTS 2530921 2/1976 Fed. Rep. of Germany .

*Primary Examiner*—Winston A. Douglas
*Assistant Examiner*—J. V. Howard
*Attorney, Agent, or Firm*—Mark DiPietro; William T. McClain; William H. Magidson

[57] ABSTRACT

Crude oil, residuum, and vacuum gas oil containing an effective amount of a linear alpha olefin substituted succinate diester of a linear primary monohydric alcohol.

8 Claims, No Drawings

FLOW IMPROVER FOR HEAVY PETROLEUM PRODUCTS COMPRISING ALKENYL SUCCINATE DIESTER

This invention relates to vacuum gas oil, crude oil, and residuum having improved low-temperature flowability. More particularly, this invention relates to residuum, crude oil, or vacuum gas oil containing a linear alpha olefin substituted succinate diester having improved low-temperature flowability.

Additives are commonly used to improve the viscosity temperature properties of petroleum products. Petroleum products should not become so thick or solidified at low temperatures that transfer of the petroleum products through lines from container to use is difficult. Residua, crude oils, and vacuum gas oils have serious cold weather drawbacks. The distribution of these heavy petroleum products by pumping through lines is more difficult or impossible at temperatures around or below untreated pour points. Furthermore, when transferring residuum crude, and vacuum gas oil to applications such as burners or petroleum processing units, the flow of the heavy, viscous petroleum products through filters, burners etc. cannot be easily maintained at low temperatures. Flow improvers for light distillates such as fuel oil, naphtha, light gas oils etc., having significantly lower viscosity, lower boiling range and lower average molecular weights than the heavy products, commonly do not prevent poor cold flowability characteristics in heavy petroleum products. Hydrocarbons in general contain waxy-type materials such as n-paraffins and naphthenes, etc. which are responsible for poor cold flow characteristics. The molecular weight of the constituents causing flowability problems in crude, residuum, and vacuum gas oil is about 400 and greater. The waxy constituents of distillate hydrocarbons are lower in molecular weight. The differences in these waxy constituents cause the differing cold flow properties and the differing response of the petroleum products to different cold flow improvers. Often in highly viscous heavy hydrocarbons, formation of waxy solids merely increases the viscosity of the thick fluid, while in light hydrocarbons the waxy-type constituents can often form a separate solid phase of particles of wax of various size.

The low-temperature properties of hydrocarbon products, and particularly residuum, crude oil, and vacuum gas oil, has attracted increased attention in recent years. The production, use and handling of heavy petroleum substances has increased in many areas in the world where low temperatures are common. This invention is of particular interest in connection with the use of heavy hydrocarbon petroleum or bituminous products derived from a variety of sources including crude oil, shale oil, tar sands, etc.

A wide variety of compounds have been found to be effective pour point depressants for hydrocarbon products. Many products which improve the flowability and filterability of light distillate products are known. However, crude oil, residua, and vacuum gas oils having differing viscosity, molecular weight range and composition than light distillates in general have not been as successfully treated.

Certain polymeric derivatives of succinic anhydride have been disclosed as flow improvers for a variety of distillate fuels. Additives which are polymeric reaction products of a paraffin with a molecular weight of 700 to 4,000 with maleic anhydride or maleic acid and subsequent semiesterification with a carbon-oxy compound having 1 to 22 carbon atoms are disclosed as improving the filterability of middle oil distillates in German Pat. No. DT 2,530,921. These compounds suffer the drawback that one reactant is a paraffin with resulting low reactivity and low conversion to the alkylated succinic acid reaction product. The additives of this reference comprise half esters of the succinic acid derivatives which do not improve the flowability of heavy petroleum products as well as diesters. A further drawback of these additives is that the high molecular weight polymers are less suitable for heavy petroleum products.

U.S. Pat. Nos. 3,381,022 to LeSuer and 3,447,916 to Edwards, both teach polyester reaction products of a succinic anhydride and polyhydric alcohols, phenols, naphthols, etc., which are useful for additives in hydrocarbons. These polyester products suffer the disadvantage that their high-molecular weight makes the products suitable only for treating low-molecular weight distillates. These products are less suitable for heavy products.

Additives are believed to prevent low-temperature flowability problems by inhibiting crystal growth. Crystals are inhibited by a mechanism in which a molecule with various substituents is adsorbed onto a growing wax crystal. A portion of the molecule resembles the crystal structure to the extent that the molecule is adsorbed into the crystal. Other portions of the molecule are unlike the crystal structure which limits further growth of the crystal by preventing deposition of additional wax molecules on the crystal. In other words, the wax molecules no longer fit the altered wax crystal structure.

The principle object of this invention is to economically improve the low-temperature flowability of vacuum gas oils, crude oils and residua containing a fraction of hydrocarbon having a boiling range greater than 343° C. (650° F.).

For the purposes of this invention the term vacuum gas oil refers to the lightest fraction of hydrocarbon distillate recovered from a vacuum distillation unit. The operation of vacuum distillation units differs from atmospheric units in the low pressures used during distillation. Often absolute pressures from about 200–50 mmHg and below are used to vaporize and remove from a crude oil or residuum additional amounts of distillate hydrocarbon. Atmospheric units operated at ambient pressure are commonly operated at temperatures up to about 343.3° C. (650° F.) and often greater. Higher temperatures when used at atmospheric pressure often result in decomposition of the remaining recoverable distillate. A vacuum unit with associated low temperature, 37.7° C.–371.1° C. (100° F.–700° F.) and pressure (50–400 mmHg) is used to remove the additional distillate with little decomposition. Vacuum gas oils commonly flash, vaporize or are removed by steam distillation at a temperature between 37.7°–93.3° C. (100°–200° F.) at about 50–75 mmHg, 149°–371.1° C. (300° F.–700° F.) at 125–150 mmHg and at 204°–649° C. (400° F. to 1,200° F.) and greater at atmospheric pressure. Residuum is that portion of the crude oil remaining after the volatile components of the crude oil have flashed in either an atmospheric or vacuum unit at temperatures up to 343° C. (650° F.) or greater. Crude oil is the well known petroleum product derived from underground reservoirs. These heavy products contain a fraction generally greater than about 10% to greater than about 50% by weight, of hydrocarbons having an atmospheric boiling range in excess of 343° C. (650° F.) Depending on conditions used in the refinery the heavy petroleum product can contain a substantial portion, at least 10 to 50% by weight and greater, of a fraction, the boiling range of which is greater than 399° C. (750° F.), 441° C. (825° F.) or 482° C. (900° F.) Often light crude oils can contain as little as 10 (wt)% of the heavy fraction.

We have found that the objects of our invention can be obtained by forming a composition comprising a heavy petroleum product containing a fraction having a boiling range greater than 343° C. (650° F.), selected from the group consisting of crude oil, residuum, vacuum gas oil, and mixtures thereof and an effective amount of a linear primary monohydric alcohol diester of a linear primary alpha olefin substituted succinic acid compound. The linear nature of the alpha olefin substituent and the substituent formed from the alcohol is critical to maintaining maximum prevention of thickening and crystal growth in the heavy petroleum product. Altering the composition of the additive by significantly isomerizing the linear substituents to branched substituents reduces the ability of the polymer to affect low temperature flowability.

Briefly, the compositions of the invention can be made by blending a heavy petroleum product with an additive prepared either by reacting a linear alpha olefin with maleic acid, maleic anhydride or fumaric acid to produce a linear alpha olefin substituted succinic acid or anhydride and then esterifying the substituted succinic acid or anhydride with a linear primary monohydric alcohol, or by esterifying a maleic acid or anhydride of fumaric acid with a linear primary monohydric alcohol and then reacting the ester with a linear alpha olefin.

The linear alpha olefins useful to prepare the compounds of the invention have the formula $CH_3(CH_2)_n—CH{=}CH_2$ wherein n is a number from about 7 to 27 These compounds are commonly produced by dehydrogenation of paraffins or by the polymerization of ethylene containing feedstocks into the various molecular weight alpha olefin compositions. The linear alpha olefins can also be separated from refinery streams containing the alpha olefins in well known processes. Examples of the useful alpha olefins are decene, dodecene, tetradecene, pentadecene, hexadecene, octadecene, eicosene, docosene, tetracosene, hexacosene, triacontene, hectene, and mixtures thereof. Preferably the alpha olefin contains about 10 to 30 carbon atoms to conserve material and maintain highest activity preventing flowability problems.

The primary monohydric alcohols useful to prepare the compounds of this invention generally have the formula:

$CH_3(CH_2)_m(CH_2OH$ wherein m is a number from about 3 to 98 These compounds are most commonly produced by the epoxidation of alpha olefins and the reduction of the epoxy group to a primary hydroxyl. However these alcohols can also be derived from natural waxes and oils. The primary monohydroxy compounds are colorless liquids with a mild odor. They are insoluble in water, partly soluble in methanol, and fully soluble in ethers and benzene. Examples of the linear primary are butanol, amyl alcohol, hexyl alcohol, heptyl alcohol, nonyl alcohol, decyl alcohol, dodecyl alcohol, eicosanol, heneicosanol, decosanol, triacontanol, pentacontanol, and hectanol, and mixtures thereof. Preferably, the monohydroxy compound contains from about 20 to 100 carbon atoms, for high activity of the additive and availability of the alcohols.

In somewhat greater detail, fumaric acid, maleic acid or maleic anhydride or diesters thereof are reacted with from about 1 to about 10 moles of the linear alpha olefin or mixtures of alpha olefin per mole of the fumaric acid, maleic acid or anhydride. The reaction mixture is heated to about 100° to 400° C. for a period of time until the reaction is complete. Preferably, about 1 to about 2 moles of alpha olefin is reacted per mole of fumaric acid, maleic acid or anhydride to produce the highest quality substituted succinic acid compound. The resulting product is a mono alpha olefin substituted linear succinic acid compound or diester thereof. The reaction is conducted without acidic catalysts since acidic catalysts apparently isomerize the alpha olefin producing a branched substituent. Since the branched substituent apparently no longer poisons the wax crystal structure, the isomerized product no longer successfully treats the flowability of heavy petroleum products.

The thermal "ENE" reaction can be carried out in inert aliphatic and aromatic solvents. For example, hexane, heptane, petroleum ether, etc., benzene, xylene, toluene, aromatic refinery streams, and ethers and other inert solvents can be used.

The maleic acid, fumaric acid, maleic anhydride or substituted succinic acid can be esterified by the reaction of about 2 to about 10 moles of the linear primary monohydroxy compound is reacted per mole of acid or anhydride. At least two moles of the primary alcohol is required to produce the diester successfully. Preferably, a slight molar excess i.e., 2.1 to 2.3 moles of the linear primary monohydric alcohol is reacted with the succinic acid reaction product to attain complete esterification and to reduce need to remove the unreacted alcohol. The esterification reaction can be carried out in the same solvents as used for the thermal "ENE" reaction.

The reaction rate of the esterification reaction can be increased with an acidic catalyst. While the alpha olefin is isomerized by acidic catalysts during the "ENE" reaction, the reaction between the primary alcohol and the substituted succinic anhydride can be catalyzed by about 0.2 to about 0.002 moles of an acidic catalyst per mole of succinic acid compound without substantial isomerization. The acidic catalyst does not appear to isomerize the olefin substituent. The acidic catalyst isomerizes only free olefins. Preferably about 0.1 to about 0.2 moles of catalyst per mole of succinic acid compound is used to lower the reaction temperature, increase the reaction rate and reduce decomposition. The esterification is conducted at a temperature between about 100° and about 300° C. The completion of the reaction is noted when water of esterification is no longer evolved in the reaction. The product is then stripped to an elevated temperature of about 200° to about 400° C. with an inert gas. The product can then be cooled and stored. The molecular weight of the alpha olefin substituted succinate can range from about 380 to about 1,800 and greater. Preferably to conserve starting material and to obtain high activity, the additive has a molecular weight of about 700.

The products in this invention can be prepared in either batch or continuous reaction. In batch reaction, the product can be prepared in one vessel with the addition of reactants at appropriate intervals. The reaction vessel can be heated to appropriate reaction temperatures with steam or other conventional heating means. In continuous processing, the reactant or reactants can be added to a vertical or horizontal reaction zone maintained as suitable temperatures and pressures. The product is then taken from the reaction zone and is then passed into appropriate processing units or strippers and filters.

The additive is incorporated in the petroleum product in sufficient concentration to lower the pour point of the hydrocarbon to a satisfactory extent. For economical reasons, the additives are preferably used in as low a concentration as possible. The alpha olefin substituted succinate diester additive can be satisfactorily used in hard to treat petroleum products in a concentration from about 1.0 to 5,000 parts per million. Preferably the product is used in the range of 100 to about 1,000 parts per million to conserve additive. The blending of the above-mentioned polymers in crude oils etc. can be facilitated by first forming polymer concentrates in suitable hydrocarbon blend stocks. Examples of suitable solvents are those containing a high proportion of aromatic hydrocarbons, e.g. toluene, xylene, kerosene or kerosene extract, this extract being the highly aromatic fraction separated from a crude kerosene by a liquid sulphur dioxide extraction process. Further suitable solvents are slack waxes, which are the waxes obtained without purification or refinining from lubricating oil dewaxing processes. Such suitable slack waxes will usually have melting points between 20° C. and 62° C. and oil contents of 5 to 50 wt. percent. The following examples and experiments are introduced to illustrate further the novelty and utility of the present invention, but not with the invention of unduly limiting the invention. The method of analysis to evaluate the cold flowability properties of the alkenyl succinate product in crudes and residua is the pour point test, ASTM D-97. Briefly, the pour point test is carried out by placing a portion of the petroleum product in a flask containing a specific amount of the additive. The additive and the petroleum product is mixed until uniform, and the flask and petroleum product containing the additive is cooled slowly at a rate of approximately 1° C. per minute. The flask is rotated until the petroleum fluid no longer flows. This temperature is the pour point.

EXAMPLE I

To a 500 milliliter flask equipped with a reflux condenser Dean-Stark trap, stirring mechanism, nitrogen atmosphere, and heating mantle, were added 18.4 grams (0.19 moles) of maleic anhydride and 50 grams (0.19 moles) of a mixture of $C_{18}$ to $C_{20}$ linear alpha olefins. The mixture was stirred and heated under a nitrogen atmosphere for 16 hours at a temperature of 193° to 205° C. The mixture was then cooled, and 171 grams (0.38 moles) of a commercial grade mixture of linear primary alcohols having from about 25 to 35 carbon atoms, and 0.5 grams of paratoluene sulfonic acid catalyst were added. The mixture was again heated to 200° C. and maintained at the temperature until water of esterification was no longer collected. The product was then stripped at 216° C. with a nitrogen atmosphere. The resultant product was cooled and collected and directly blended into petroleum products.

EXAMPLE II

Example I was repeated except the paratoluene sulfonic acid was added to the maleic anhydride prior to the addition of the linear alpha olefin.

TABLE I

| | Additive in Vacuum Gas-Oil (distillation in TABLE II) | |
|---|---|---|
| Example | Concentration of Adding Wt. % | ASTM Pour Point in Degrees, °C. (°F.) |
| I | 0.05 | 4.4 (40) |
| | 0.10 | 1.7 (35) |
| | 0.20 | −1.1 (30) |
| II | 0.20 | 20.0 (68) |
| (Blank) | 0.00 | 21.1 (70) |

Table I shows the improved flowability properties of the additive containing from 500 (0.05 wt.%) to 2,000 (a 0.20 wt.%) parts per million of the additive. The additive containing 2,000 parts per million has an ASTM pour point reduced from 70° to 30° F., a 40° difference. The table also shows that the isomerized alpha olefin substituted succinate diester produced by the reaction between the alpha olefin and the succinic anhydride in the presence of an acidic catalyst has essentially no cold-flow improving properties.

TABLE II

| Distillation of Vacuum Gas Oil Used in TABLE I | | |
|---|---|---|
| | °C. | °F. |
| 1.0% | 207 | 405 |
| 5.0% | 254 | 490 |
| 10.0% | 276 | 529 |
| 20.0% | 302 | 575 |
| 30.0% | 324 | 615 |
| 40.0% | 342 | 647 |
| 50.0% | 361 | 681 |
| 60.0% | 379 | 714 |
| 70.0% | 399 | 750 |
| 80.0% | 422 | 792 |
| 90.0% | 456 | 853 |
| 95.0% | 484 | 904 |
| 99.0% | 524 | 976 |
| Final BP | 534 | 993 |

Table II shows the distillation of the gas oil tested in Table I.

TABLE III

| | | Pour Points, °C. (°F.) | |
|---|---|---|---|
| Example | Conc (ppm) | Residuum | Crude |
| I | 500 | 7.2 (45) | 21.1 (70) |
| | 750 | 10 (50) | 15.6 (60) |
| | 1,000 | 1.7 (35) | 12.8 (55) |
| II | 500 | 15.6 (60) | 29.4 (85) |
| | 750 | 12.8 (55) | 29.4 (85) |
| | 1,000 | 18.3 (65) | 29.4 (85) |
| Blank | — | 15.6 (60) | 29.4 (85) |

Table III shows the improvement in the flowability properties of crude oil and residua caused by the product of Example I, and the inability of the isomerized products of Example II to significantly effect the pour point.

We claim:

1. A composition having improved low-temperature flowability comprising a heavy petroleum product containing a fraction having a boiling range greater than about 343° C. (650° F.) and a low-temperature flow improving amount of a linear primary monohydric alcohol diester of a linear primary alpha olefin substituted succinic acid compound.

2. The composition of claim 1 wherein the heavy petroleum product contains 1 to 5,000 parts per million of the linear primary monohydric alcohol diester of a linear primary alpha olefin substituted succinic acid compound.

3. The composition of claim 1 wherein the linear alpha olefin substituted succinic acid compound is linear alpha olefin substituted succinic acid or linear alpha olefin substituted succinic anhydride.

4. The composition of claim 1 wherein the linear alpha olefin contains about 10 to 30 carbon atoms.

5. The composition of claim 1 wherein the linear primary monohydric alcohol contains 20 to 100 carbon atoms.

6. The composition of claim 1 wherein the heavy petroleum product is selected from the group consisting of vacuum gas-oil, residuum, crude oil, and mixtures thereof.

7. The composition of claim 1 wherein the fraction having a boiling range greater than about 343° C. (650° F.) comprises greater than about 10 (wt)% of the heavy petroleum product.

8. The composition of claim 1 wherein the fraction having a boiling range greater than about 343° C. (650° F.) comprises greater than about 50 (wt)% of the heavy petroleum product.

* * * * *